US011585169B2

(12) United States Patent
Liezenberg

(10) Patent No.: US 11,585,169 B2
(45) Date of Patent: Feb. 21, 2023

(54) RISER MOUNTED CONTROLLABLE ORIFICE CHOKE

(71) Applicant: Schlumberger Technology Corporation, Sugar Land, TX (US)

(72) Inventor: Bastiaan Liezenberg, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 266 days.

(21) Appl. No.: 15/781,474

(22) PCT Filed: Dec. 2, 2016

(86) PCT No.: PCT/US2016/064516

§ 371 (c)(1),
(2) Date: Jun. 4, 2018

(87) PCT Pub. No.: WO2017/096101

PCT Pub. Date: Jun. 8, 2017

(65) Prior Publication Data

US 2020/0263513 A1 Aug. 20, 2020

Related U.S. Application Data

(60) Provisional application No. 62/262,907, filed on Dec. 3, 2015.

(51) Int. Cl.
*E21B 21/08* (2006.01)
*E21B 34/06* (2006.01)

(52) U.S. Cl.
CPC ..... *E21B 21/08* (2013.01); *E21B 34/06* (2013.01)

(58) Field of Classification Search
CPC ..... E21B 21/08; E21B 34/06
USPC ..... 166/359
See application file for complete search history.

(56) References Cited

U.S. PATENT DOCUMENTS 4,094,492 A * 6/1978 Beeman ..... F16K 3/03 138/45
4,210,208 A * 7/1980 Shanks ..... E21B 17/01 166/352
6,273,193 B1 8/2001 Hermann et al.
6,904,981 B2 6/2005 van Riet
7,185,719 B2 3/2007 van Riet
7,350,597 B2 4/2008 Reitsma et al.
9,016,381 B2 * 4/2015 Dietz ..... E21B 21/08 166/344
9,068,420 B2 * 6/2015 Rajabi ..... E21B 21/001
9,157,285 B2 * 10/2015 Orbell ..... E21B 17/085

(Continued)

OTHER PUBLICATIONS

International Search Report and Written Opinion for the equivalent International patent application PCT/US2016/064516 dated Mar. 22, 2017.

(Continued)

*Primary Examiner* — Matthew R Buck
*Assistant Examiner* — Patrick F Lambe
(74) *Attorney, Agent, or Firm* — Kelly McKinney

(57) ABSTRACT

An apparatus includes a variable orifice choke disposed within a riser. The riser is connected between a drilling platform and a wellbore. A control unit is in signal communication with the variable orifice choke. The control unit is operable to control a flow area of the variable orifice choke such that a selected fluid pressure is maintained in the wellbore.

12 Claims, 3 Drawing Sheets

(56) References Cited

U.S. PATENT DOCUMENTS

| | | | | |
|---|---|---|---|---|
| 9,388,657 | B2 * | 7/2016 | Nelson | E21B 33/06 |
| 2003/0168220 | A1 * | 9/2003 | Patel | E21B 34/10<br>166/375 |
| 2012/0168171 | A1 | 7/2012 | Verpe | |
| 2012/0279719 | A1 * | 11/2012 | Baugh | E21B 17/10<br>166/349 |

OTHER PUBLICATIONS

International Preliminary Report on Patentability for the equivalent International patent application PCT/US2016/064516 dated Jun. 14, 2018.

Preliminary Office Action issued in Brazilian patent application BR112018011267-4 dated Aug. 4, 2020, 6 pages.

* cited by examiner

RISER MOUNTED CONTROLLABLE ORIFICE CHOKE

CROSS REFERENCE TO RELATED APPLICATIONS

This application claims priority to and the benefit of a US Provisional application having Ser. No. 62/262,907, filed Dec. 3, 2015 which is incorporated by reference herein.

BACKGROUND

This disclosure relates to the field of managed pressure wellbore drilling. More specifically, the disclosure relates to controllable orifice chokes used in managed pressure wellbore drilling.

Subterranean wellbore drilling methods include so called "managed pressure" drilling methods. Examples of such methods are described in U.S. Pat. No. 6,904,981 issued to van Riet, U.S. Pat. No. 7,185,719 issued to van Riet, and U.S. Pat. No. 7,350,597 issued to Reitsma. Managed pressure drilling methods and apparatus used to perform such methods may include a controllable orifice flow restriction or "choke" in a conduit from which fluid is discharged from a wellbore during certain drilling operations. Fluid may be pumped into the wellbore through a conduit such as a drill string that extends into the wellbore. Fluid may be returned to the surface by passing through an annular space between the wall of the wellbore and the conduit. In managed pressure drilling apparatus, the conduit may be closed to release of fluid using a device such as a rotating control device (RCD) which seals the annular space while enabling rotation and axial motion of the conduit. Fluid leaving the annular space may be discharged through an outlet line hydraulically connected below the RCD. The variable orifice choke may be disposed in the outlet line. By controlling a rate at which fluid is pumped into the wellbore through the conduit such as a drill string, and by selectively controlling the flow restriction provided by the choke in the outlet line, fluid pressure in the annular space may be controlled. Such fluid pressure control may provide, among other benefits, the ability to use lower density fluid for wellbore drilling operations than would otherwise be required if the annular space were not pressurized as a result of the flow restriction provided by the controllable orifice choke.

In certain types of marine drilling methods, a pipe or casing is disposed in a portion of a wellbore that begins at the bottom of a body of water. The casing extends to a selected depth in the wellbore, whereupon drilling of the wellbore may continue. A wellbore pressure control apparatus such as a blowout preventer (BOP) may be coupled to the top of the casing, just above the water bottom. A conduit called a "riser" may extend from the BOP to a drilling platform above the water surface. Using managed pressure drilling methods and apparatus such as the examples provided in the above listed U.S. patents may require the use of an RCD proximate the BOP at the base of the riser, or may require an RCD proximate the top of the riser. Other equipment associated with the managed pressure drilling apparatus may be similar to that used where no riser is required.

DETAILED DESCRIPTION

Figure 1:
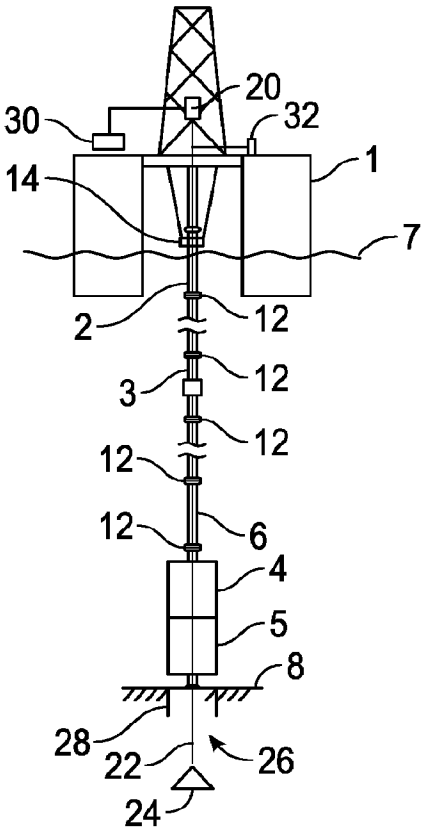
FIG. 1 shows an example embodiment of drilling a well below the bottom of a body of water using a riser to connect a wellhead to a drilling platform on the water surface. The riser includes an example embodiment of a choke according to the present disclosure.

An example embodiment of a well drilling system is shown schematically in FIG. 1. The illustrated well drilling system is a marine drilling system. The well drilling system may include a drilling platform 1 disposed proximate the surface 7 of a body of water. The drilling platform 1 may be buoyantly supported on the surface 7 as illustrated or may be bottom supported. Fluid pumps 30 may be disposed on the drilling platform 1 to pump drilling fluid into a swivel or top drive 20 which suspends an upper end of a drill string 22 in a wellbore 26 being drilled below the bottom 8 of the body of water. A drill bit 24 may be disposed at the lower end of the drill string 22 to drill the wellbore 26. Drilling fluid which is pumped through the drill string 22 leaves the wellbore 26 through an annular space (not illustrated separately) between the drill string 22 and the wall of the drilled wellbore, upwardly through a surface casing 28 placed in the wellbore 26.

The surface casing 28 may be connected to a well pressure control apparatus 5 such as a blowout preventer (BOP) assembly of any type known in the art. The BOP 5 may be coupled to a lower marine riser package (LMRP) 4 at a lower end of the LMRP 4. An upper end of the LMRP 4 may be connected to a riser 6. In the present example embodiment, the riser 6 may be assembled from a plurality of elongated segments coupled end to end using a coupling 12 at each longitudinal end. The coupling 12 may be any type known in the art, including without limitation, threaded couplings, threaded tool joints, flush joint connections, and as illustrated in FIG. 1, mating flanges at each longitudinal end of each riser segment. The riser 6 may extend to a telescoping joint 2 if the drilling platform floats on the water surface or is otherwise buoyantly supported. A tensioner ring 14 may be coupled to the riser proximate the telescoping joint 2 to maintain the riser 6 in tension by applying some of the buoyant force exerted by the drilling platform 1 to the riser 6. Maintaining the riser 6 in tension may reduce the possibility of riser failure by collapse under the weight thereof. In the example embodiment shown in FIG. 1, a riser mounted, variable orifice choke 3 may be disposed at a selected longitudinal position within the riser 6.

As drilling fluid leaves the surface casing 28 it enters the BOP 5 and the LMRP 4, and then enters the riser 6 to be returned to the drilling platform 1 through a discharge line 32.

Figure 3:
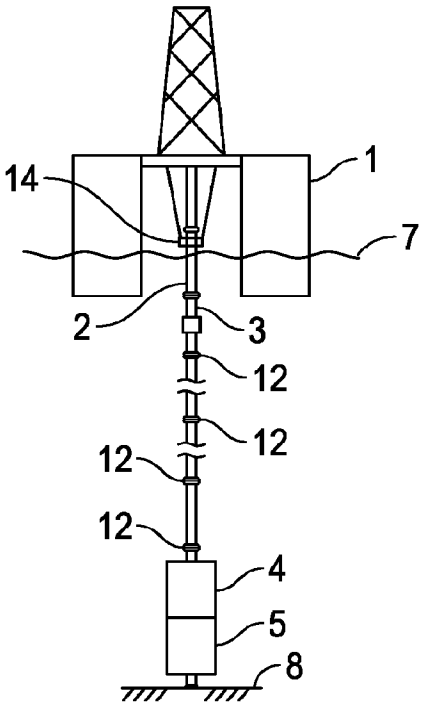
FIGS. 2 and 3 show placement of a choke according to FIG. 1 at different longitudinal positions along the riser.
Figure 2:
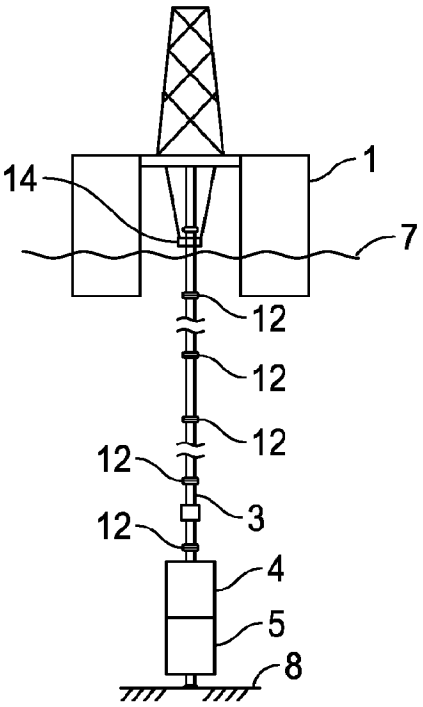

FIGS. 2 and 3 show different configurations of a drilling system as in FIG. 1, but with the variable orifice choke 3 disposed at different longitudinal positions along the riser 6. FIGS. 2 and 3 are intended to illustrate that the position of the variable orifice choke 3 along the riser 6 is a matter of discretion for the drilling platform operator and is not to be construed as a limit on the scope of the present disclosure.

Figure 4:
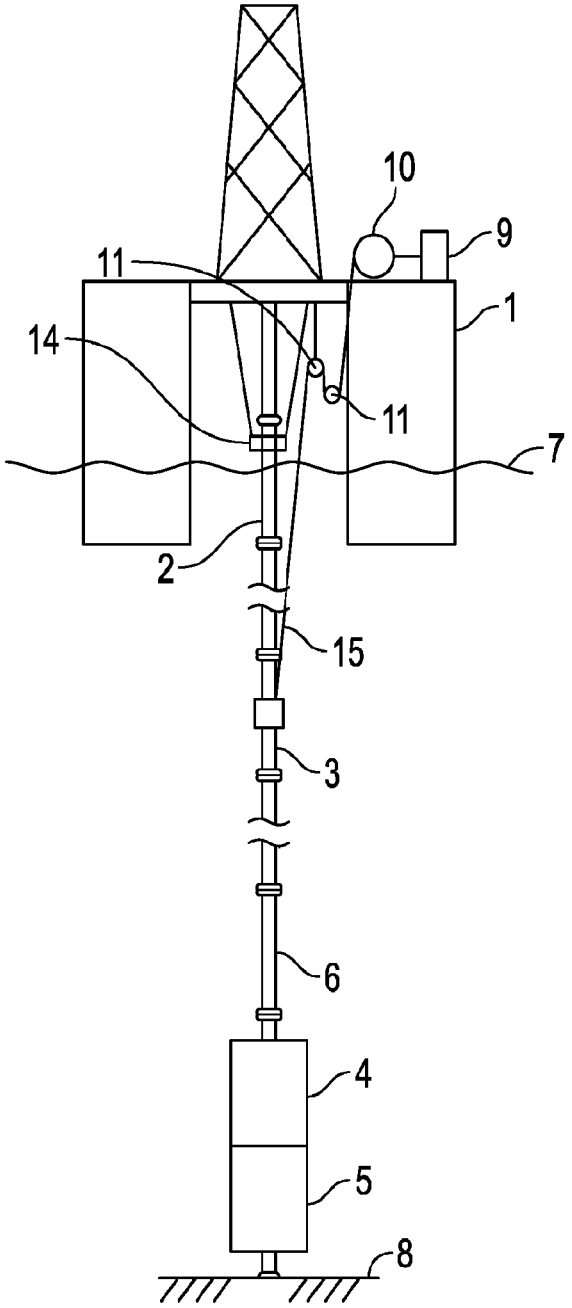
FIG. 4 shows an example embodiment of connection of a choke as in FIG. 1 to a control unit disposed on the drilling platform.

As will be further explained, the variable orifice choke 3 may have a variable cross sectional flow area so as to present a variable, controllable restriction to flow of drilling fluid upwardly in the riser 6. By controlling the cross sectional flow area of the variable orifice choke 3, it is possible to control the pressure of drilling fluid in the wellbore (26 in FIG. 1). Controlling the pressure of the drilling fluid by controlling the cross sectional flow area of the variable orifice choke 3 is similar in principle to controlling pressure of drilling fluid in a wellbore as explained in U.S. Pat. No. 7,350,597 issued to Reitsma. FIG. 4 shows schematically a control unit 9 having thereon equipment (not shown separately) for operating the variable orifice choke 3 to have at any time a selected cross sectional flow area to result in a selected drilling fluid pressure in the wellbore. The control unit 9 may have thereon a processor (not shown separately) which may generate, for example, electrical, pneumatic or hydraulic control signals to operate the variable orifice choke 3 in response to measurements of flow rate of drilling fluid into the wellbore (28 in FIG. 1) and pressure of the drilling fluid at any point along the interior of the riser 6 or in the wellbore (28 in FIG. 1) for the purpose of maintaining a selected drilling fluid pressure in the wellbore (28 in FIG. 1). The control signals from the control unit 9 may be communicated to the variable orifice choke 3 by an electrical, hydraulic and/or pneumatic umbilical line 15. The umbilical line 15 may be suspended by sheaves 11 to enable the umbilical line 15 to be adjusted for changes in elevation of the drilling platform 1 above the water bottom 8 due to tide and wave action on the water surface 7. The umbilical line 15 may be extended and retracted for deployment and retrieval, respectively, by a winch 10 or any other known spooling device.

Figure 5:
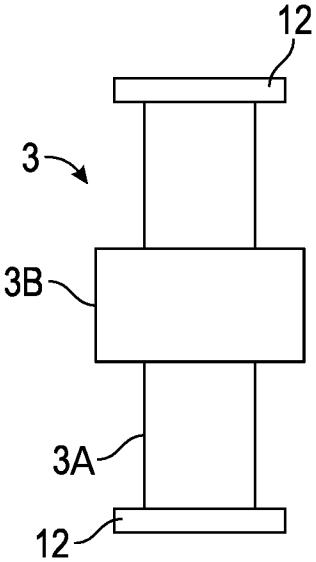

FIG. 5 shows a side view of one example embodiment of the variable orifice choke 3. The variable orifice choke 3 may comprise a housing 3A which may have a substantially similar cross-sectional shape as any one or more of the segments of the riser (6 in FIG. 1). Each longitudinal end of the housing 3A may have a coupling 12 thereon enabling the housing 3A to be connected between any two selected segments of the riser (6 in FIG. 1). As explained with reference to FIG. 1, the couplings 12 may be any type known in the art for connecting segments of conduit end to end, including without limitation, threaded couplings such as collars, flush joint threads, tool joint threads and as illustrated in the example embodiment of FIG. 5, mating flanges. The housing 3A has a larger diameter portion 3B at a selected position along the length of the housing 3A. The larger diameter portion 3B is provided to hold components of the variable orifice choke 3 that selectively enlarge or contract the cross sectional flow area of the variable orifice choke 3.

Figure 7:
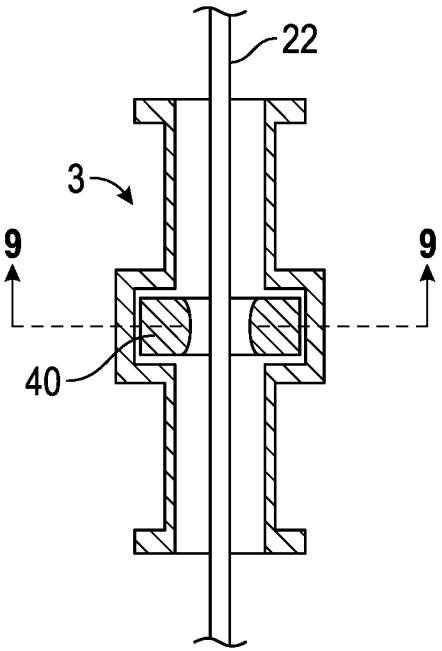
FIGS. 5 through 7 show various views of an example embodiment of a choke according to the present disclosure.
Figure 9:
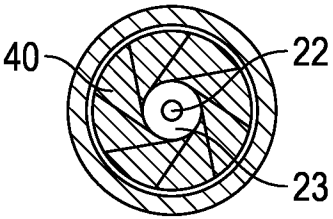
FIGS. 8 and 9 show, respectively, a cross-section of a choke according to the present disclosure in its fully opened position and in an at least partially closed position, respectively.
Figure 6:
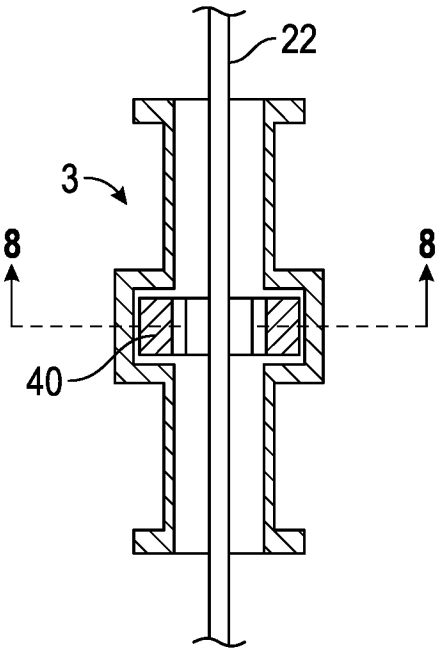
Figure 8:
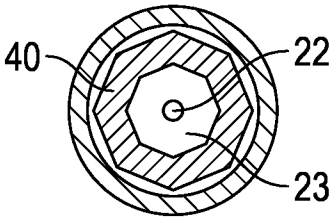

FIG. 6 shows a cross sectional view of the variable orifice choke 3 wherein the drill string 22 is inserted therethrough as would be the case during drilling with the variable orifice choke 3 disposed in the riser (6 in FIG. 1). A closure element 40 may be operated by a control signal (e.g., as conducted over the umbilical line 10 in FIG. 4) to provide a selectable cross sectional flow area between an interior surface of the closure element 40 and the exterior of the drill string 22. In the cross section shown in FIG. 6, the closure element 40 is in its fully opened position. In some embodiments, when the closure element 40 is fully open, an internal diameter of the closure element may be approximately the same as an internal diameter of the riser (6 in FIG. 1) so as to create minimal disturbance in flow of drilling fluid upwardly through the riser (6 in FIG. 1). FIG. 7 shows a cross section of the variable orifice choke with the closure element 40 at least partially closed so that the cross sectional flow area between the interior surface of the closure element 40 and the exterior of the drill string 22 is reduced. Vertical sectional views of the cross-sections of FIGS. 6 and 7 are shown in FIGS. 8 and 9, respectively, with each of the foregoing figures showing the relative sizes of the cross sectional flow area 23.

The closure element 40 may be any device that can controllably reduce or increase the effective internal diameter thereof when operated. Non-limiting examples of closure elements may include inflatable bladders, such as those used in annular blowout preventers, "iris" type variable flow orifices and a plurality of circumferentially spaced apart pistons with wear resistant material on an inward facing surface thereof. Such pistons may be each slidably disposed in a respective hydraulic or pneumatic cylinder such that application of hydraulic or pneumatic pressure causes the respective piston to be moved inwardly toward the center of the housing 3A.

A well drilling system with a variable orifice choke disposed in a riser may eliminate the need for a rotating control device, may enable relatively rapid and efficient replacement of the variable orifice choke if required and may reduce the amount of deck space required to operate a managed pressure drilling system when used on a marine drilling system.

While the present disclosure has been made with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system, comprising:

a variable orifice choke disposed at a longitudinal position along a riser, the riser connected between a drilling platform and a wellbore, wherein the variable orifice choke is disposed along the riser such that a drill string extends through each of the variable orifice choke and the riser;

a casing placed in the wellbore, creating an annular space between the drill string and the casing;

a well pressure control apparatus connected to the casing;

a lower marine riser package (LMRP) having a lower end and an upper end, wherein the lower end of the LMRP is connected to the well pressure control apparatus, and the upper end of the LMRP is connected to the riser; and a control unit in signal communication with the variable orifice choke, the control unit operable to control a flow area of the variable orifice choke such that a selected fluid pressure is maintained in the wellbore, wherein the variable orifice choke comprises: a housing having a coupling at longitudinal ends thereof for connection between two selected external segments of the riser; and a closure element disposed in a larger diameter portion of the housing, the closure element being operable to adjust a cross sectional flow area through an interior of the housing.

2. The system of claim 1 wherein the closure element comprises an iris type variable flow orifice.

3. The system of claim 1 wherein the closure element comprises an inflatable bladder.

4. The system of claim 1 wherein the coupling at each longitudinal end comprises a mating flange.

5. The system of claim 1 wherein an internal diameter of the closure element is substantially the same as an internal diameter of the riser when the closure element is fully opened.

6. The system of claim 1 further comprising an umbilical line forming signal connection between the variable orifice choke and the control unit.

7. The system of claim 1 wherein a lower end of the riser comprises a lower marine riser package coupled to a well pressure control apparatus, the well pressure control apparatus coupled to an upper end of a casing disposed in the wellbore.

8. A method, comprising:

automatically controlling a cross sectional flow area of a variable orifice choke such that flow of fluid returning to a drilling platform from a wellbore is restricted so as to maintain a selected fluid pressure in the wellbore, wherein the variable orifice choke is disposed at a longitudinal position along a riser such that a drill string extends through the riser and the variable orifice choke, and wherein a well pressure control apparatus is connected to a casing placed in the wellbore, wherein a lower end of a lower marine riser package (LMRP) is connected to the well pressure control apparatus, and an upper end of the LMRP is connected to the riser, wherein the variable orifice choke comprises: a housing having: a coupling at longitudinal ends thereof for connection between two selected segments of the riser; a larger diameter portion between the couplings; and a remotely operable closure element disposed in the larger diameter portion of the housing.

9. The method of claim 8, wherein the remotely operable closure element comprises an inflatable bladder.

10. The method of claim 8, wherein the remotely operable closure element comprises an iris type variable flow orifice.

11. The method of claim 8, wherein an internal diameter of the variable orifice choke is substantially the same as an internal diameter of the riser when the variable orifice choke is fully opened.

12. The method of claim 8, wherein the cross-sectional flow area is defined between an interior surface of the remotely operable closure element and an exterior of the drill string.

* * * * *